US007595106B2

(12) United States Patent
Ahlen et al.

(10) Patent No.: US 7,595,106 B2
(45) Date of Patent: Sep. 29, 2009

(54) METHOD FOR MANUFACTURING CEMENTED CARBIDE

(75) Inventors: Niklas Ahlen, Fagersta (SE); Rolf Olofsson, Fagersta (SE)

(73) Assignee: Seco Tools AB, Fagersta (SE)

( * ) Notice: Subject to any disclaimer, the term of this patent is extended or adjusted under 35 U.S.C. 154(b) by 62 days.

(21) Appl. No.: 11/261,913

(22) Filed: Oct. 31, 2005

(65) Prior Publication Data

US 2006/0093508 A1 May 4, 2006

Related U.S. Application Data

(60) Provisional application No. 60/622,803, filed on Oct. 29, 2004.

(51) Int. Cl.
*C22C 1/05* (2006.01)

(52) U.S. Cl. ..... 428/325; 75/240; 75/245

(58) Field of Classification Search ..... 51/307, 51/309; 75/240, 245; 501/87; 428/325
See application file for complete search history.

(56) References Cited

U.S. PATENT DOCUMENTS

| | | | | |
|---|---|---|---|---|
| 5,009,705 | A * | 4/1991 | Yoshimura et al. | 75/240 |
| 5,484,468 | A * | 1/1996 | Ostlund et al. | 75/236 |
| 6,117,533 | A * | 9/2000 | Inspektor | 51/307 |
| 6,132,293 | A | 10/2000 | Littecke | |
| 6,207,102 | B1 | 3/2001 | Rohlin | |
| 6,207,262 | B1 * | 3/2001 | Ichikawa et al. | 51/307 |
| 6,221,479 | B1 * | 4/2001 | Waldenstrom et al. | 51/307 |
| 6,250,855 | B1 * | 6/2001 | Persson et al. | 51/309 |
| 6,267,797 | B1 * | 7/2001 | Ostlund et al. | 75/240 |
| 6,333,100 | B1 | 12/2001 | Palmqvist | |
| 7,179,319 | B2 * | 2/2007 | Heinrich et al. | 75/236 |

FOREIGN PATENT DOCUMENTS

JP 61-012847 * 1/1986

* cited by examiner

*Primary Examiner*—Archene Turner
(74) *Attorney, Agent, or Firm*—WRB-IP LLP

(57) ABSTRACT

The invention relates to a method of making cemented carbides having surfaces free free of detrimental binder phase layer. This is achieved by the inclusion of controlled amounts of carbonitride in the carbide composition. The invention also relates to the cemented carbides so formed.

15 Claims, 3 Drawing Sheets

METHOD FOR MANUFACTURING CEMENTED CARBIDE

BACKGROUND OF THE INVENTION

The present invention relates to a cemented carbide insert and method of manufacture via sintering, wherein the as-formed sintered insert is free of binder phase surface layer. The surface of the insert thus has a binder content similar to or less than the binder content of the bulk phase.

During the almost 70 years that cemented carbides have been used for metal cutting, constant improvements have been made in the field of cemented carbide insert production. The increasing use of powder compaction to near net shape has led to a need for cemented carbide grades with well defined surfaces that are suited for physical vapour deposition (PVD), chemical vapour deposition (CVD) and medium temperature chemical vapour deposition (MTCVD) coating without pre-treatment. Such inserts are commonly made of a metallic carbide, normally WC, generally with the addition of carbides of other metals such as Nb, Ti, Ta, etc. and a metallic binder phase of cobalt. To increase wear resistance, it is common to apply a thin layer of one or more wear resistant materials such as TiC, TiN, $Al_2O_3$ etc. to the surface.

A problem common to many cemented carbide grades is the presence of a binder phase surface layer partly or fully covering the outer tungsten carbide grains. This unwanted binder phase layer, which can be greater than 1 μm thick, develops during the sintering step. If a binder phase layer is present on the surface, it can have a negative effect on CVD and PVD processes, resulting in layers with inferior mechanical properties and insufficient adherence of the coating to the substrate. The binder phase layer must therefore be removed before carrying out the deposition process. The occurrence of the binder layer correlates with tungsten carbide grain size. In general, as grain size decreases below about 2 μm, and particularly below about 1.5 μm, binder phase becomes more prevalent on the surface and hence more problematic with respect to mechanical properties and coating adhesion. Fine and submicron grades of cemented carbide are particularly subject to surface binder formation.

While the art has addressed the problem of binder phase formation in a variety of ways, most of these can be grouped into two broad categories. In a first category are those methods that prevent the binder phase from initially forming. In a second category are methods that do allow the binder phase to form initially on the surface, and then attempt to remove the binder by mechanical or chemical means.

As previously stated, a binder phase surface layer tends to occur in cemented carbide grades with grain sizes smaller than about 2 μm. Hence simply by keeping grain size above the limit for binder phase formation, the entire problem is avoided. Larger grain sizes, however, carry their own disadvantages. For example, at a given binder level in the bulk cemented carbide, the room temperature (RT) hardness, i.e., resistance to plastic deformation, decreases with increasing grain size. In like manner, to obtain a given RT hardness level, the level of binder must be decreased as the tungsten carbide grain size is increased. Since toughness increases with higher levels of binder, the net effect is that either RT hardness or toughness usually suffers as grain size increases.

This trade-off between hardness and toughness at larger grain size is addressed in a unique way by U.S. Pat. No. 6,333,100 which teaches the addition of high levels of cubic carbide (4-12 wt. %) to a powder composition. The resulting sintered carbide insert of this patent has a cobalt binder phase enriched and essentially cubic carbide free surface zone of a certain thickness and composition along either side of a cutting edge. This, combined with the optimisation of cubic carbide near the cutting edge, contributes to simultaneous improvements in resistance to plastic deformation and toughness. At the same time, because the actual surface of the insert (as opposed to a surface zone which is immediately below the surface) is free of excess binder phase because of inter alia the large gain size used, coatings will remain adhered to the insert and mechanical properties will be maintained.

While the teachings of this patent clearly advance the art by improving the trade-off of using large tungsten carbide grains in cemented carbides, it does so at the expense of directly addressing the problem of binder phase formation with smaller grain sizes. As a result, the advantages of using smaller grain sizes are foregone. Moreover, the patent requires a number of specific features to be combined which may require careful monitoring, such as the specified certain thickness of the binder phase enriched surface zone. This may in some instances increase production costs compared to processes with less stringent composition and geometry requirements.

Binder phase formation can also be suppressed by tightly controlling cooling temperature, as described in U.S. Pat. No. 6,207,102, which teaches rapid cooling of the cemented carbide after sintering. The rapid cooling produces a surface with no binder phase layer. This method, while effective, requires specialised equipment and monitoring of the cooling step to produce the desired result.

Methods of the second category, that is, those methods, which allow a binder layer to initially form, and then attempt to remove it, include steps such as mechanical removal by blasting. Blasting, however, is difficult to control because of the inability to accurately control blasting depth. This in turn leads to increased scatter in the properties of the coated insert end product and damage to the hard constituent grain of the substrate surface. However, in U.S. Pat. No. 6,132,293, it is disclosed that blasting with fine particles gives an even removal of the binder phase layer without damaging the hard constituent grains.

Alternatively, chemical or electrolytic methods could be used to remove the binder layer. However these methods remove more than just the cobalt surface layer. They also result in deep penetration, particularly in areas close to the insert edge. This may create an undesired porosity between layer and substrate at the same time the binder layer may partly remain in other areas of the insert.

A further drawback of the above mentioned prior art methods is that they require additional production steps to remove the surface binder layer and for that reason are less attractive for large scale production. It would be desirable if sintering could be performed in such a way that no binder phase layer is formed.

OBJECTS AND SUMMARY OF THE INVENTION

It is therefore an object of the present invention to provide a method for increasing the adherence of a coating layer to a cemented carbide substrate.

It is another object of the invention to provide a method, as above, whereby the increased adherence is effected by controlling the amount of binder phase at the substrate surface without the need for specialised temperature control during sintering.

It is yet another object of the invention to provide a method, as above, which eliminates the need for mechanical or chemical removal of surface binder layer in a post-sintering step.

It is still another object of the invention to provide a method, as above, which provides precise control of the amount of binder phase present on the post-sintered substrate surface by varying the powder composition.

It is yet another object of the invention to provide a method, as above, which allows the manufacture of cemented carbide grades having a small grain size without concomitant formation of a binder phase surface layer.

It is yet another object of the invention to provide a cemented carbide insert formed from the above method.

It is still another object of the invention to provide a cemented carbide insert, as above, having a strongly adhered surface coating applied thereto by chemical or physical vapour deposition.

These objects and others set forth in the following specification, are achieved by a method for manufacturing cemented carbides which comprises providing a mixture of tungsten carbide, a binder containing cobalt, iron or nickel or any combination thereof, and a cubic phase [(Ti,Zr,Hf,Ta,Nb)(C,N)] comprising a mixture of cubic carbonitrides and/or carbides in amounts sufficient to inhibit the accumulation of the binder on a surface of the sintered article, forming the mixture into a shaped article, and sintering the shaped article to form a sintered article.

The objects of the invention are also achieved by a method of making coated cemented carbide bodies with a composition of 3 to 15 weight % of binder, with a cubic phase that comprise from not less than (0.17×Co content) wt %, e.g., 1 wt % for Co=6 wt %, with a maximum of 4.0 wt %. The composition has a Ti/[cubic phase] weight ratio of between about 0.08 and about 1.0 for the metals, which means that the cubic phase composition can range from pure $Ti(C_{1-x}N_x)$ to a composition with only small amount of Ti. Nitrogen content (mol ratio) expressed as N/Ti is greater than 0.05 and less than 0.6. Chromium carbide comprises from zero to about 2 wt %, preferably from about 0.2 to about 1.5 wt % for grain sizes smaller than 1 μm, and the rest is WC. The method includes the step of sintering the cemented carbide by heating to sintering temperature. Preferred methods of sintering the present invention include sinterHIP and vacuum sintering, whereby nitrogen can be added through the cubic phase, and/or as nitrogen gas prior to reaching Ts (sintering temperature). Suitable Ts are in the range 1380-1500° C., and sintering time 10-90 min, followed by cooling, applying post sintering treatment, providing the bodies with a thin wear resistant coating including at least one layer by CVD-, MTCVD- or PVD-technique, and applying a post coating treatment such as brushing and/or drag finishing.

BRIEF DESCRIPTION OF THE DRAWINGS

For a fuller understanding of the invention, the following detailed description should be read in conjunction with the drawings, wherein.

DETAILED DESCRIPTION OF THE PREFERRED EMBODIMENTS OF THE INVENTION

Figure 1:
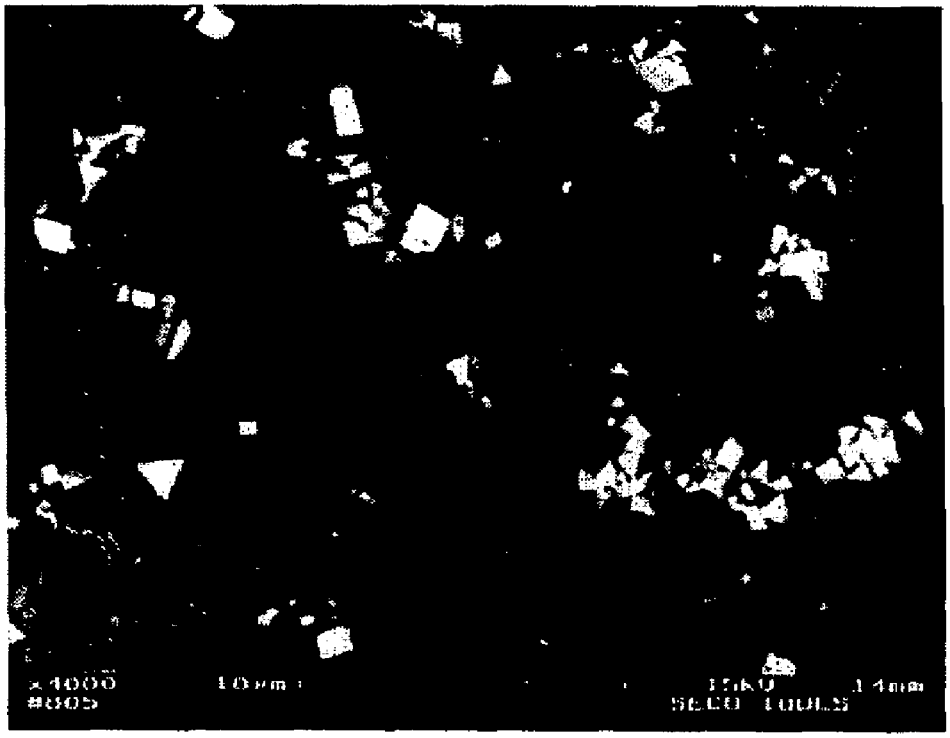
FIG. 1. (PRIOR ART)
FIG. 1 shows in 4000× magnification a top view of the surface of prior art cemented carbide inserts almost covered with binder phase layer, and having a composition of 6.0 wt % Co, 0.5 wt % chromium carbide and rest WC of 0.8 μm grain size.

The present invention provides for a method of making cemented carbide articles, such as inserts for cutting tools, having surfaces with a controlled level of binder phase material in the as-sintered state. In particular, it has been discovered that the level of binder phase material on a cemented carbide surface can be controlled by adding relatively small amounts of cubic carbonitride to a powder composition used to form the cemented carbide. The binder phase level can be controlled even for those grades of cemented carbides having tungsten carbide grains of 1.5 μm in size or less, and even down to submicron grades.

The role played by the cubic phase in controlling surface binder composition was heretofore unrecognized and thus wholly unexpected. Also unexpected was the ability to isolate the effect on binder level to the surface, leaving other areas of the cemented carbide relatively unaffected. Thus with the addition of relatively small amounts of cubic carbonitride, it is possible to achieve a controlled level of binder at the surface with little or no binder enrichment immediately below the surface itself, i.e., in the so-called surface zone. This can be seen by comparing FIG. 1 with FIGS. 2-4.

By "controlled level" is meant that the amount of binder phase on the surface of the carbide article can be varied as a function of manufacturing parameters, in particular by the addition of cubic carbonitride to the powder mixture and/or by the addition of nitrogen gas during the sintering step. By varying the amount and composition of cubic carbonitride, added in the powder or formed in situ with nitrogen gas during sintering, the amount of binder at the surface can be controlled to be similar to the amount of binder in the bulk phase of the cemented carbide, or it can be decreased from the bulk phase level. For purposes of the invention, it is preferred to control the amount of surface binder to be less than the amount of binder in the bulk phase. In either case, the cemented carbide surface is free of excess detrimental binder phase layer. Control of surface binder levels, and in particular the ability to prevent the unwanted accumulation of binder to levels higher than in the bulk phase, is thereby achieved without the problems associated with previous methods such as by mechanically removing surface binder phase after it has formed, or by closely controlling the cooling of the sintered article via specialised temperature control equipment.

The cemented carbide of the invention comprises a first phase based on tungsten carbide (WC) which is bound by means of a second phase comprising a metallic binder based on cobalt (Co), iron (Fe), nickel (Ni) or combinations thereof, and additional phases comprising a mixture of cubic carbonitrides and/or carbides [(Ti,Zr,Hf,Ta,Nb)(C,N)] in amounts sufficient to inhibit the accumulation of the binder on a surface of the sintered article and/or chromium carbide. In a highly preferred embodiment, the binder phase is cobalt.

Although it is possible to use tungsten carbide grades having large grain sizes, the benefits of the invention are realized using finer grades. The grades of tungsten carbide useful as the first phase thus include those having a grain size of about 1.5 μm or less, and preferably about 1.0 μm or less.

Figure 3:
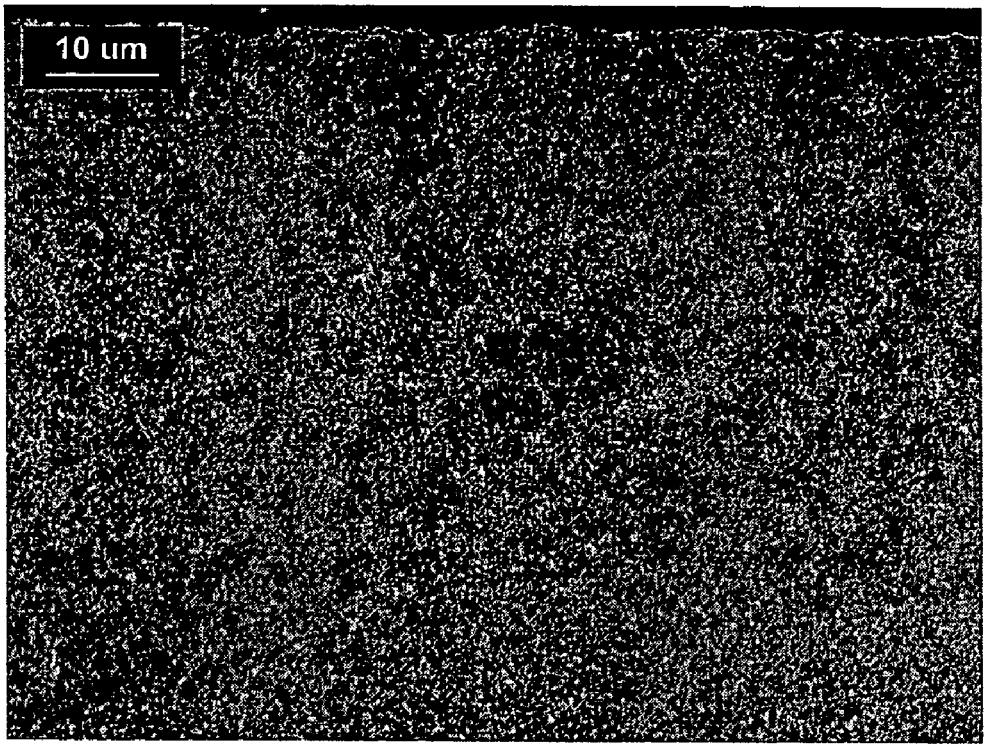
FIG. 3 shows in 1000× magnification a polished cross section of the cemented carbide with a composition comprising of 6 wt % Co, 0.5 wt % chromium carbide, 2 wt % of cubic carbonitride [(Ti,Ta,Nb)(C,N)] with 0.5 wt % Ti and a N/Ti ratio of about 0.4, and rest WC of 0.8 μm grain size.
Figure 4:
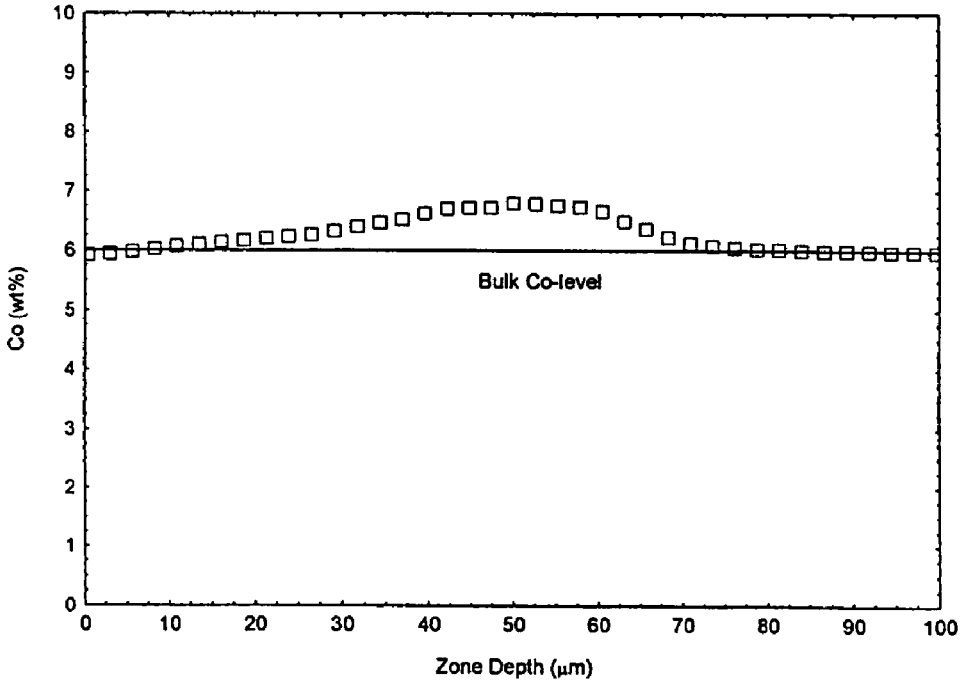
FIG. 4 shows a plot of Co-content versus depth from the surface down to 100 μm, of a cemented carbide according to the present invention with a composition comprising 6 wt % Co, 0.5 wt % chromium carbide, 2 wt % of cubic carbonitride ((Ti,Ta,Nb)(C,N)) with 0.5 wt % Ti and a N/Ti ratio of about 0.4, and rest WC of 0.8 μm grain size.

When this material is subjected to sintering, it is surprisingly found that the otherwise commonly occurring excess binder phase is not present. A cubic carbide free zone is formed, as shown in FIGS. 3 and 4, with the binder phase concentration at the surface being at most the same as the bulk of the cemented carbide, and usually considerably less. The end result is surprisingly a material without the binder surface layer and that looks and behaves like a substrate with the same binder content, without cubic carbonitride. The cubic carbonitride additions are made in sufficiently small amounts such that the effect on physical properties, e.g., hardness and fracture toughness, is minimal compared to cemented carbide without the addition, yet in high enough quantities, that is, greater than their room temperature solubility limit, so that the cubic phase re-precipitates during cooling of the sintered cemented carbide.

While not being bound by a particular theory, it is believed that the cubic carbonitride dissolves below the surface of the insert and reprecipitates in the bulk of the insert where the nitrogen activity is higher than in the surface zone, with the binder phase filling the void below the surface left by the dissolved carbonitride.

Sintering techniques useful in the present invention are described in detail in e.g. U.S. Pat. Nos. 4,277,283, 4,610,931, 4,548,786, 6,554,548, and 6,333,100 and in WO 98/16665, all of which are hereby incorporated by reference in their entirety. While the sintering techniques described in these patents are similar to those used in the present invention, the prior patents describe materials that have surface zones that are heavily enriched in cobalt and hence with significant differences in material characteristics in the surface as compared to the bulk material. Preferred methods of sintering the present invention include sinterHIP, and vacuum sintering, whereby nitrogen can be added thru the cubic phase, and/or as nitrogen gas prior to reaching Ts. Sintering temperatures used are in the range 1380-1500° C., preferably 1390-1460° C., and sintering time 10-90 min, preferably 30-60 min. The amount of added nitrogen will determine the overall distribution of the elements in the cemented carbide after solidification through the rate of dissolution of the cubic phases during the sintering process. The optimum amount of nitrogen to be added depends on the composition of the cemented carbide and in particular on the amount of cubic phases. The exact conditions depend to a certain extent on the design of the sintering equipment being used.

The binder phase will after sintering contain tungsten and other added elements in amounts corresponding to their respective solubility in the binder phase at room temperature. Only the amount of added chromium, if any, is preferably below the solubility limit of binder phase at room temperature.

In a preferred embodiment according to the invention, an insert useful for fine turning of stainless steel and Ni-based alloys has a Co content of 4.8-5.8 wt % with 0.16-0.36 wt % chromium carbide, 1.5-2.0 wt % cubic carbonitrides [$(Ti_aTa_bNb_c)(C,N)$], with composition where (a+b+c)=1; 0.1<a<0.5; 0.5<b+c<0.8 and 0.10<N(mol)/Ti(mol)<0.45, and the amount of binder at the surface is about 2.5-3.0 wt %. The insert has a PVD coating with 1-3 μm of $(Ti_{1-x}Si_x)N$, where x is between 0.1-0.2 and/or a PVD $(Ti_{1-x}Al_x)N$ coating where x is between 0.6-0.7, with a mean intercept length of the tungsten carbide phase measured on a ground and polished representative cross section is in the range 0.5-0.9 μm. The intercept length is measured by means of image analysis on micrographs with a magnification of 10000× and calculated as the average mean value of approximately 1000 intercept lengths. In a further preferred embodiment a top layer of TiN and/or CrN and/or ZrN, or mixture thereof is deposited outermost.

In another preferred embodiment an insert for medium to rough turning of stainless steel and Ni-based alloys has a Co content of 4.8-5.8 wt % with 0.16-0.36 wt % chromium carbide, 1.5-2.0 wt % cubic carbonitrides [$(Ti_aTa_bNb_c)(C,N)$], with composition where (a+b+c)=1; 0.1<a<0.5; 0.5<b+c<0.8 and 0.10<N(mol)/Ti(mol)<0.45, and the amount of binder at the surface is about 2.5-3.0 wt %. The insert is provided with a CVD coating of total thickness 3-15 μm comprised mainly of $Al_2O_3$, with a mean intercept length of the tungsten carbide phase in the range 0.5-0.9 μm. In a further preferred embodiment a CVD top layer of TiN and/or ZrN, or mixture thereof is deposited outermost.

In yet another preferred embodiment, inserts for threading, grooving and parting off have a Co content of 7.5-8.5 wt % with 0.26-0.52 wt % chromium carbide, 1.5-2.0 wt % cubic carbonitrides [$(Ti_aTa_bNb_c)(C,N)$], with composition where (a+b+c)=1; 0.1<0.5; 0.5<b+c<0.8 and 0.10<N(mol)/Ti(mol)<0.45, and the amount of binder at the surface is about 3.5-5 wt %. The insert is provided with a PVD coating of 1-3 μm of $(Ti_{1-x}Si_x)N$, where x is between 0.1-0.2 and/or a PVD $(Ti_{1-x}Al_x)N$ coating where x is between 0.6-0.7, with a mean intercept length of the tungsten carbide phase in the range 0.5-0.9 μm. In a further preferred embodiment a top layer of TiN and/or CrN and/or ZrN, or mixture thereof is deposited outermost.

In yet another preferred embodiment, inserts for milling have a Co content of 9.2-10.1 wt % with 0.36-0.62 wt % chromium carbide, 1.5-2.0 wt % cubic carbonitrides [$(Ti_aTa_bNb_c)(C,N)$], with composition where (a+b+c)=1; 0.1<a<0.5; 0.5<b+c<0.8 and 0.10<N(mol)/Ti(mol)<0.45, and the amount of binder at the surface is about 4-5.5 wt %. The insert is provided with a PVD coating of 1-3 μm of $(Ti_{1-x}Si_x)N$, where x is between 0.1-0.2 and/or a PVD $(Ti_{1-x}Al_x)N$ coating where x is between 0.6-0.7, with a mean intercept length of the tungsten carbide phase in the range 0.5-0.9 μm. In a further preferred embodiment a top layer of TiN and/or CrN and/or ZrN, or mixture thereof is deposited outermost.

In yet another preferred embodiment, inserts for face milling of hardened steels have a Co content of 4.6-5.3 wt % with 0.20-0.35 wt % chromium carbide, 1.5-2.0 wt % cubic carbonitrides [$(Ti_aTa_bNb_c)(C,N)$], with composition where (a+b+c)=1; 0.1<a<0.5; 0.5<b+c<0.8 and 0.10<N(mol)/Ti(mol)<0.45, and the amount of binder at the surface is about 2-3 wt %. The insert is provided with a PVD coating of 1-3 μm of $(Ti_{1-x}Si_x)N$, where x is between 0.1-0.2 and/or a PVD $(Ti_{1-x}Al_x)N$ coating where x is between 0.6-0.7, with a mean intercept length of the tungsten carbide phase in the range 0.3-0.7 μm. In a further preferred embodiment a top layer of TiN and/or CrN and/or ZrN, or mixture thereof is deposited outermost.

Additional general and preferred ranges of the cemented carbides according to the present invention are as follows, with all percentages-based on total weight of the powder mixture.

The binder comprises from about 3 to about 15 wt % of the powder, preferably from about 4 to about 10 wt %. The cubic carbonitride comprise from not less than (0.17×Co content) wt %, e.g., 1 wt % for Co=6 wt % with a maximum of 4.0 wt % carbonitride, desirably from not less than (0.2×Co content) wt %, e.g., 1.2 wt % for Co=6 wt % with a maximum of 3.5 wt % carbonitrides, preferably from not less than (0.2×Co content) wt %, e.g., 1.2 wt % for Co=6 wt % with a maximum of 3.0 wt % carbonitrides and most preferably from not less than (0.22×Co content) wt %, e.g., 1.32 wt % for Co=6 wt % with a maximum of 2.2 wt % carbonitrides. Chromium carbide comprises from zero to about 2 wt %, preferably from about 0.2 to about 1.5 wt % for grain sizes smaller than 1 μm. Nitrogen content (mol ratio) expressed as N/Ti is greater than about 0.05 and less than about 0.6, preferably greater than about 0.15 and less than about 0.55, and the remainder WC having a grain size of from about 0.2 to about 1.5 μm, preferably a grain size from about 0.4 to about 1.21 μm. In addition, the composition has a Ti/carbonitride weight ratio of between about 0.08 and about 1.0, which means that the carbonitride composition can range from pure Ti(C,N) to a composition with only a small amount of Ti.

The method of the present invention provides positive effects on the productivity and versatility of possible substrates, geometry and coating combinations for cemented carbides. This in turn results in higher overall productivity, better production economy and better products.

According to the present invention the sintering is performed in a conventional manner and no investment in new equipment is needed. The optimum composition of cubic carbonitride phase is dependent on the composition of the cemented carbide and on the sintering conditions. The amount of binder on the surface can be determined by the use of Scanning Electron Microscopy (SEM) equipped with energy-dispersive spectrometer (EDS) and comparing the intensities of an unknown surface to a polished cross section of the same nominal composition.

EXAMPLE 1

A.) Cemented carbide insert of the type CNMG120408 with 6.0 wt % Co, 0.5 wt % chromium carbide and rest WC of 0.8 μm grain size, was sinterHIP' ed at 1420° C. in conventional manner (60 min at Ts; $P_{(ar)}$max=30 bar; and with a cooling rate of less than 6° C./min from Ts). The surface was up to 98% covered with binder layer, as shown in FIG. 1.

Figure 2:
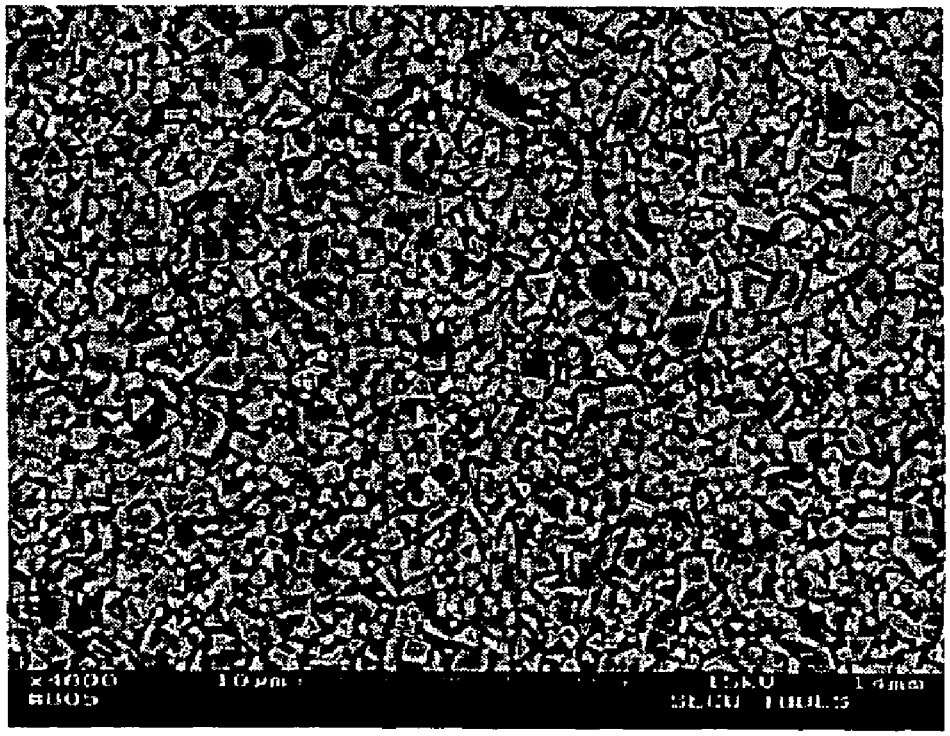
FIG. 2 shows in 4000× magnification a top view of the surface of cemented carbide inserts according to the invention having a composition of 6 wt % Co, 0.5 wt % chromium carbide, 2 wt % of cubic carbonitride ((Ti,Ta,Nb)(C,N)) with 0.5 wt % Ti and a N/Ti ratio of about 0.4, and rest WC of 0.8 μm grain size. The angular grains are WC and between them there is binder phase.

B.) Inserts of type CNMG120408 with 6 wt % Co, 0.5 wt % chromium carbide, 2 wt % of cubic carbonitride ((Ti,Ta,Nb)(C,N)) with 0.5 wt % Ti and a N/Ti ratio of about 0.4, and rest WC of 0.8 μm grain size, sintered in the same way as above, had a surface covered with about 3 wt % Co, which lower than the nominal value of 6 wt %, as shown in FIG. 2. The carbide free zone was approximately 60-70 μm deep, with a maximum Co enrichment of 0.8 wt % ($Co_{max}$−$Co_{bulk}$)

EXAMPLE 2

A cemented carbide insert of the type SNUN 120408 with 6.0 wt % Co, 1.5 wt % cubic carbide and rest WC of 1.5 μm grain size, was vacuum sintered in conventional manner at Ts=1460° C. (60 min at Ts; $P_{(ar)}$=50 mbar; and with a cooling rate of less than 10° C./min from Ts). The surface was up to 45% covered with binder layer. Inserts with 6.0 wt % Co, 1.5 wt % cubic carbonitride ((Ti,Ta,Nb)(C,N)) with 0.25 wt % Ti and a N/Ti ratio of about 0.4, and rest WC of 1.5 μm grain size, sintered in the same manner as above, had a surface covered with about 3 wt % Co, which is lower than the nominal value of 6 wt %. The carbide free zone was approximately 60-70 μm deep, with a maximum Co enrichment of 0.7 wt % ($Co_{max}$−$Co_{bulk}$)

EXAMPLE 3

This example will illustrate the advantage of the present invention in machining.

C.) Inserts from A were coated using PVD-technique with a 3 μm coating of $(Ti_{35}Al_{75})N/TiN$.

D.) Inserts from B were coated using PVD-technique with a 3 μm coating of $(Ti_{35}Al_{75})N/TiN$.

E.) Inserts from A were coated using MTCVD- and CVD-techniques with a coating of 2 μm Ti(C,N) and 2 μm $Al_2O_3$.

F.) Inserts from B were coated using MTCVD- and CVD-techniques with a coating of 2 μm Ti(C,N) and 2 μm $Al_2O_3$.

Inserts from C and E were tested and compared with inserts from D and F with respect to tool life in longitudinal turning operation.

Figure 5:
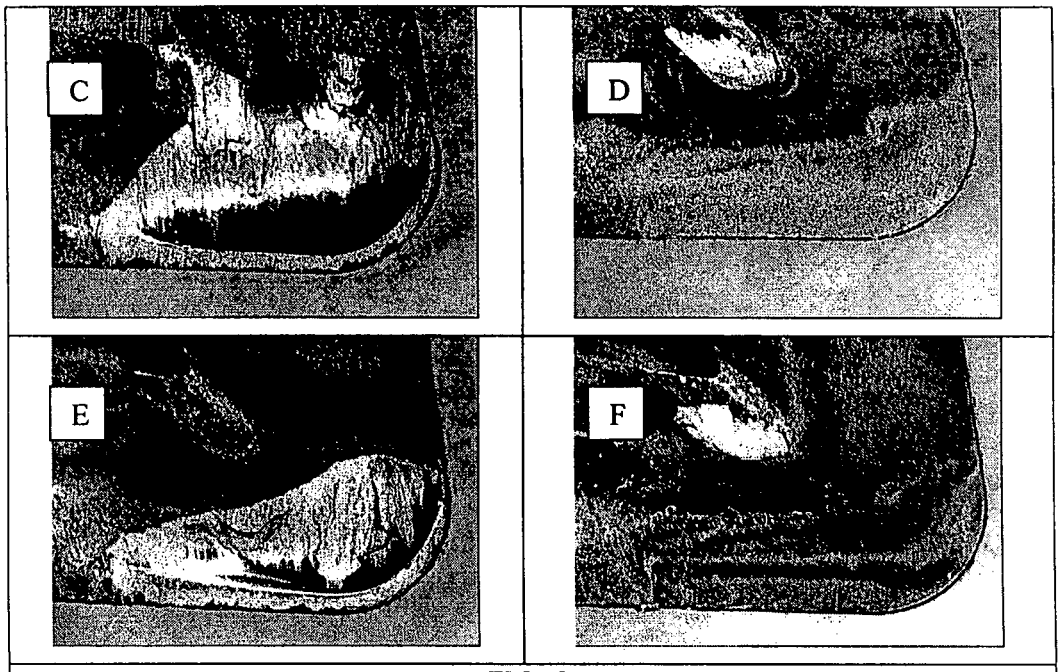
FIG. 5 shows in 40× magnification a top view of coated cemented carbide inserts after machining in 1 min. C and E show heavy crater wear. D and F according to the invention show better wear resistance to crater wear and therefore exhibit longer tool life.

Time in cut: 60 s
Material: Stainless steel 316 L
Cutting speed: 140 m/min
Feed: 0.4 mm/rev
Depth of cut: 2 mm
Remarks: Wet turning The test results seen in FIG. 5 show that cemented carbide inserts according to the invention, D and F, exhibit longer tool life, especially to crater wear, than C (prior art) and E (prior art). The invention illustrates the advantages of combining a cemented carbide surface containing equal to or lower than the nominal binder phase content with CVD- and MTCVD- or PVD-techniques.

The principles, preferred embodiments and modes of operation of the present invention have been described in the foregoing specifications. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered cemented carbide, comprising a binder selected from the group consisting of cobalt, iron, nickel and mixtures thereof, from about 1.0% to less than 4 wt % of a cubic carbonitride comprising at least one of the elements Ti, Zr or Hf in an amount sufficient to inhibit the accumulation of the binder on a surface of the sintered cemented carbide, and the remainder tungsten carbide having an average grain size of about 1.5 μm or less, and wherein the percentage of binder at said surface is no greater than in the bulk phase of said carbide, and wherein the amount of carbonitride is no less than about 0.17 times the amount of binder.

2. The cemented carbide according to claim 1, wherein the maximum amount of carbonitride is about 3.5 wt %.

3. The cemented carbide according to claim 2, wherein the amount of carbonitride is no less than about 0.20 times the amount of binder.

4. The method according to claim 1, wherein the maximum amount of carbonitride is about 3.0 wt %.

5. The cemented carbide according to claim 4, wherein the amount of carbonitride is no less than about 0.20 times the amount of binder.

6. The cemented carbide according to claim 1, wherein the maximum amount of carbonitride is about 2.2 wt %.

7. The cemented carbide according to claim 6, wherein the amount of carbonitride is no less than about 0.22 times the amount of binder.

8. The cemented carbide according to claim 1, further comprising chromium carbide in an amount of greater than zero and up to about 2 wt %.

9. The cemented carbide according to claim 1, further comprising chromium carbide in an amount of greater than zero and up to about 1.0 wt %.

10. The cemented carbide according to claim 1, wherein the tungsten carbide has an average grain size of from about 0.2 to about 1.5 μm.

11. The cemented carbide according to claim 1, wherein the tungsten carbide has an average grain size of from about 0.4 to about 1.2 μm.

12. The cemented carbide according to claim 1, wherein the binder comprises cobalt and wherein the amount of cobalt binder at the surface is from about 50% to about 75% of the amount of binder in the bulk phase.

13. The cemented carbide according to claim 1, wherein the carbonitride component of said cemented carbide has a Ti/carbonitride weight ratio of between about 0.08 and about 1.0.

14. The cemented carbide according to claim 1, wherein the tungsten carbide has a grain size of 1.0 μm or less.

15. A sintered cemented carbide, consisting essentially of a binder selected from the group consisting of cobalt, iron, nickel and mixtures thereof, from about 1.0% to less than 4 wt % of a cubic carbonitride comprising at least one of the elements Ti, Zr or FIf in an amount sufficient to inhibit the accumulation of the binder on a surface of the sintered cemented carbide, and the remainder tungsten carbide having an average grain size of about 1.5 μm or less, and wherein the percentage of binder at said surface is no greater than in the bulk phase of said carbide, and wherein the amount of carbonitride is no less than about 0.17 times the amount of binder.

* * * * *